US010085575B2

(12) United States Patent
Vogel

(10) Patent No.: US 10,085,575 B2
(45) Date of Patent: Oct. 2, 2018

(54) FOLDING TWO SECTION PILLOW COMPRISED OF HORSESHOE AND CONTOUR PILLOWS

(71) Applicant: Joseph D Vogel, Woodstock, GA (US)

(72) Inventor: Joseph D Vogel, Woodstock, GA (US)

( * ) Notice: Subject to any disclaimer, the term of this patent is extended or adjusted under 35 U.S.C. 154(b) by 448 days.

(21) Appl. No.: 14/729,525

(22) Filed: Jun. 3, 2015

(65) Prior Publication Data

US 2015/0351564 A1 Dec. 10, 2015

Related U.S. Application Data

(60) Provisional application No. 62/008,060, filed on Jun. 5, 2014.

(51) Int. Cl.

| | |
|---|---|
| ***A47G 9/10*** | (2006.01) |
| ***A47C 7/38*** | (2006.01) |
| *A47G 9/00* | (2006.01) |

(52) U.S. Cl.

CPC ..... *A47G 9/1081* (2013.01); *A47C 7/383* (2013.01); *A47G 9/1054* (2013.01); *A47G 2009/003* (2013.01); *A47G 2009/1018* (2013.01)

(58) Field of Classification Search

CPC ..... A47G 9/10
USPC ..... 5/630, 632, 636, 640
See application file for complete search history.

(56) References Cited

U.S. PATENT DOCUMENTS

| | | | | | |
|---|---|---|---|---|---|
| 3,009,172 | A * | 11/1961 | Eidam | A47G 9/10 | 5/632 |
| 4,394,783 | A * | 7/1983 | Simmons | A47C 7/425 | 297/230.1 |
| 4,473,913 | A * | 10/1984 | Ylvisaker | A47C 20/021 | 5/632 |
| 4,665,573 | A * | 5/1987 | Fiore | A47C 27/146 | 5/731 |
| 5,682,633 | A * | 11/1997 | Davis | A47G 9/1081 | 5/636 |
| 6,154,903 | A * | 12/2000 | Wai-Chung | A47C 20/026 | 5/632 |
| 7,020,918 | B1 * | 4/2006 | Tinsley | A47C 16/00 | 5/630 |
| 2004/0172761 | A1 * | 9/2004 | Druery | A47C 20/021 | 5/650 |
| 2006/0080780 | A1 * | 4/2006 | Schlieps | A47C 9/027 | 5/657 |
| 2010/0146708 | A1 * | 6/2010 | Sakata | A63B 21/00047 | 5/655.3 |
| 2013/0263377 | A1 * | 10/2013 | Wootten, Jr. | A47C 23/00 | 5/640 |

* cited by examiner

*Primary Examiner* — Fredrick C Conley
(74) *Attorney, Agent, or Firm* — Southease IP Group, LLC.; Thomas L. Moses

(57) ABSTRACT

A transformable, multi-function, detachable, foldable, two piece pillow which allows for comfortable and ergonomically correct prone, supine and seated use is provided. The two piece design is comprised of an upper wedged contour pillow and a lower horseshoe pillow, which may be used together or separately. The two pillow design allows for both pillows to be used together in different configurations, or separately to provide for comfortable and ergonomically correct prone, supine and seated use.

19 Claims, 9 Drawing Sheets

FOLDING TWO SECTION PILLOW COMPRISED OF HORSESHOE AND CONTOUR PILLOWS

BACKGROUND OF THE INVENTION

Sitting or lying down is often an uncomfortable proposition for travelers, sunbathers, campers, desk workers and fitness participants. Even sitting or lying on typical home or outdoor furniture can be uncomfortable. Most chairs and lounges do not provide sufficient or proper cervical and lumbar spine support, making them uncomfortable and potentially harmful to the spine. Many mattresses may also fail to provide sufficient spinal support. Currently available portable cushions or pillows are limited in versatility, portability and capability of providing comfort and ergonomically correct support to the spine and head.

BRIEF DESCRIPTION OF THE INVENTION

The present invention relates to a transformable, multifunction, detachable, foldable, two piece pillow which allows for comfortable and ergonomically correct prone, supine and seated use. The two piece design is comprised of an upper wedged contour pillow and a lower horseshoe pillow, which may be used together or separately as described herein. The two pillow design of the present invention allows for both pillows to be used together in different configurations, or separately to provide for comfortable and ergonomically correct prone, supine and seated use.

The upper wedged contour pillow may be comprised of at least two different surfaces, which will be labeled and described herein as surface side "A" and surface side "B". Side "A" is a preferably flat surface which can fold or flip on top of the corresponding upper surface of the horseshoe pillow. Side "B" is the preferably contoured surface with cervical/lumbar roll and transitional wedge shape.

It is contemplated that the present invention as described may be used for a myriad of uses and is not limited by the uses described herein. Some of these uses include sunbathing, weightlifting, exercising, traveling, sleeping or receiving a massage. Such use may provide for comfortable and ergonomically correct positioning and support while lying prone on one's stomach and avoids the spinal discomfort associated with turning the head to the side.

DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

The present invention relates to a transformable, multifunction, detachable, foldable, two piece pillow 20 which allows for comfortable and ergonomically correct prone, supine and seated use. In a preferred embodiment, the two piece design is comprised of an upper wedged contour pillow 21 and a lower horseshoe pillow 22, which may be used together or separately as shown in FIGS. 1-16 and further described herein. The two pillow design of the present invention allows for both pillows to be used together in different configurations, or separately to provide for comfortable and ergonomically correct prone, supine and seated use. An optional adjustable handle for carrying or affixing to luggage or the like may be attached preferably to the front or back edge of either or both pillows.

The arrangement and configurations of the present invention are not limited by the configurations disclosed herein. It is to be understood that other configurations and combinations of use are possible, in addition to those described. Although the folding two section pillow 20 set forth herein may be described in terms of specific dimensions, it should be understood that these dimensions are used for illustrative purposes only, and other dimensions, shapes and sizes may be used while adhering to the spirit and scope of the present invention.

Figure 1:
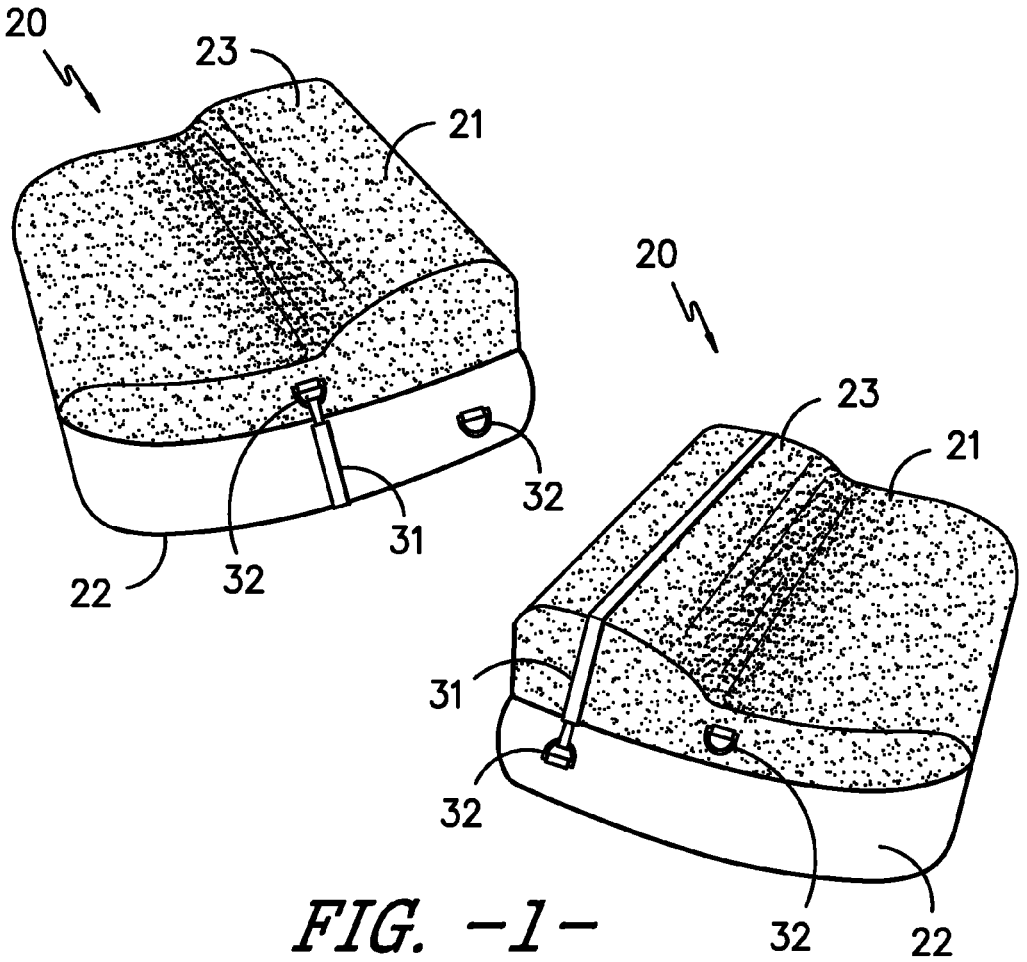
FIG. 1 illustrates a perspective view of a preferred embodiment of the two pillow combination configuration with the upper wedged cervical pillow atop the lower horseshoe pillow.

The upper wedged contour pillow 21 may be comprised of at least two different surfaces, which will be labeled and described herein as surface side "A" and surface side "B". Side "A" is a preferably flat surface which can fold or flip on top of the corresponding surface of the horseshoe 22 pillow as shown in FIG. 1. Side "B" is preferably a contoured surface with cervical/lumbar roll 23 and transitional wedge shape as shown best in FIGS. 1-4 and 8-12. Although, it is contemplated that the upper wedged pillow may not be contoured and may be generally flat on both sides, similar to a traditional pillow. Similarly, the horseshoe pillow may be contoured on one or both sides, if so desired. Contours may include rolls and/or massage type bumps of varying sizes and shapes.

The two pillows may be used together or separately to provide a multitude of configurations. FIG. 1 illustrates one possible configuration whereby the two piece design can be used in an attached combination as an elevated cervical support pillow. This may be accomplished by folding, or flipping, the flat surface (side "A") of the upper contoured pillow 21 on top of the horseshoe pillow 22, such that the contoured surface (side "B") may be facing in an upwardly direction as shown. It is contemplated that a lateral edge of the wedged contour pillow 21 may be attached to a corresponding lateral edge of the horseshoe pillow 22, such that surface side "A" of the contour pillow 21 may be folded to come in contact and rest atop the upper surface of the horseshoe pillow 22. Similarly, the contour pillow 21 may be detached from the horseshoe pillow 22 and reattached such that the opposite surface, side "B", of the contour pillow 21 is now facing the upper surface of the horseshoe pillow 22, as depicted by FIG. 2.

Figure 6:
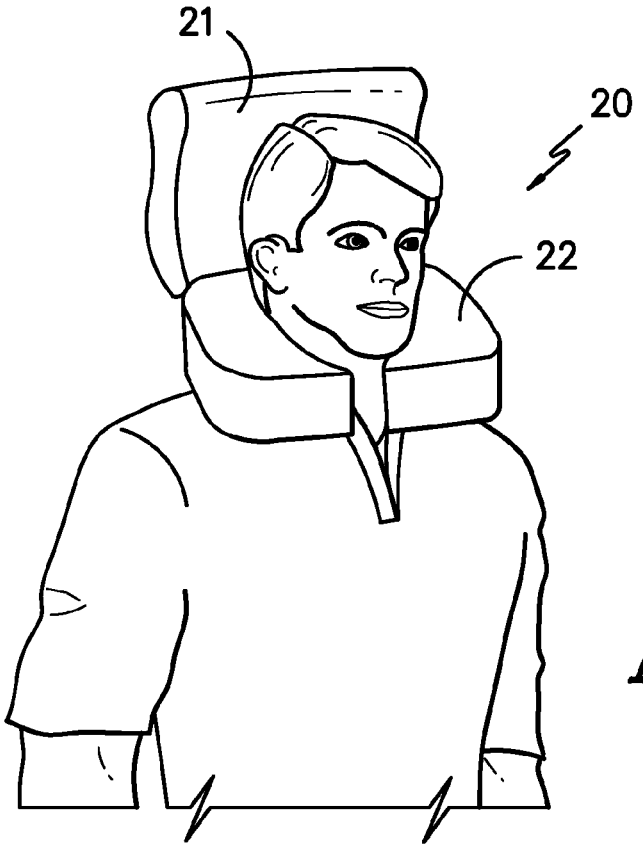
FIG. 6 illustrates an in-use view of a preferred embodiment of the attached two pillow configuration with lower cervical horseshoe pillow around the neck and upper contour wedged pillow as a head cushion and lateral support.

FIG. 6 illustrates another possible configuration, whereby the two piece attached combination design is further capable of being used with the lower cervical horseshoe pillow 22 preferably positioned around the neck, and the upper wedged contour pillow 21 preferably positioned as a lateral support cushion whereby surface side "A" is positioned against the back of the head. It is contemplated that the contour pillow 21 may be oriented at a desired upwardly degree behind the head, preferably approximately 90 degrees, to provide additional cushion and lateral support to the head, as depicted in FIG. 6. In an alternate configuration, rather than being positioned against the back of the head, the wedged contour pillow 21 may be positioned downward such that it supports the shoulders and thoracic region of the spine, still attached to the horseshoe pillow 22- or the contour pillow 21 may be detached from the horseshoe pillow 22 and positioned such that it supports the lumbar spine while the horseshoe pillow 22 may remain positioned around the neck.

It is contemplated that these combination two pillow configurations described can be used in a variety of situations, such as while seated in an airplane, automobile, lounge chair or the like. These configurations may also be used while lying in a supine position or any other use as desired. Surface side "A" of the contour pillow 21 may also incorporate a slight curvature to stabilize and bend with the curve and contour of the user's head. A more curved bottom horizontal surface on the lower horseshoe pillow 22 may be incorporated to promote the outer edges of the pillow 22 to pull inward and provide lateral support for the head when used as a cervical horseshoe pillow and back head support pillow. In another embodiment, the upper contour pillow 21 may be abbreviated, or designed smaller. For example, rather than providing a full contour pillow, the pillow 21 may be comprised of tubular or rectangular cushion that may be attached to the horseshoe cushion 22 in the manner previously described.

Figure 2:
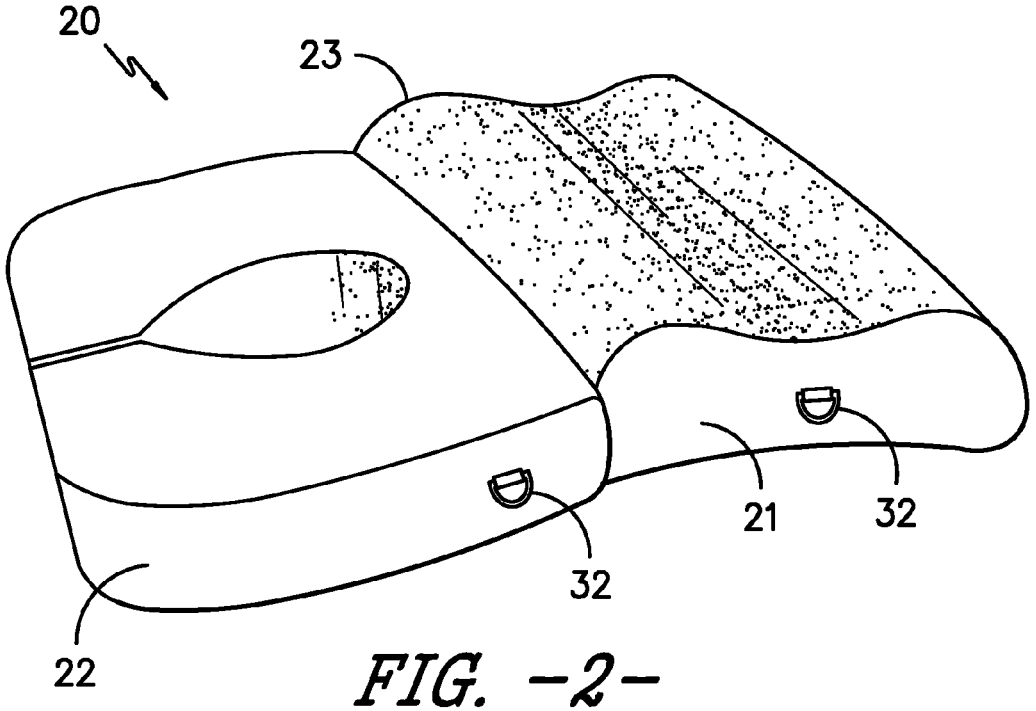
FIG. 2 illustrates a perspective view of a preferred embodiment of the two pillow configuration with the upper wedged cervical pillow and lower horseshoe pillow attached for prone, face down, use.
Figure 8:
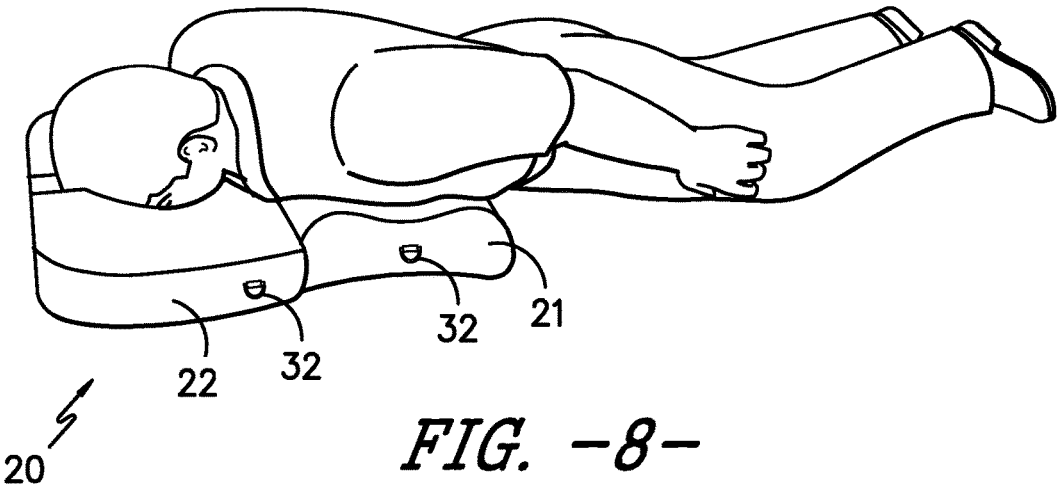
FIG. 8 illustrates an in-use view of a preferred embodiment of the two pillow configuration when utilized for prone, face down, use.

In yet another configuration illustrated best by FIGS. 2 and 8, the wedged horseshoe pillow 22 may be used in an attached combination with the contour pillow 21, whereby the horseshoe pillow 22 may function as an adjustable face down (prone) cushion, while the contour pillow 21 may provide a gradual elevation from the abdomen to the chest and head, as shown in FIG. 8. The upper surface of the contour pillow 21 (side "B") may be preferably tapered with the thicker, cervical roll 23 preferably similar in thickness to that of the horseshoe pillow 22. In a preferred embodiment, this cervical roll 23 thickness may be approximately 3 inches and may gradually taper to approximately 1 to 2 inches at the opposite edge of the contour pillow 21. The preferably tapered design of surface side "B" of the contour pillow 21 allows for comfortable transition from the lower, abdominal area to the elevated height where the head is positioned into the opening of the horseshoe pillow 22.

Figure 5:
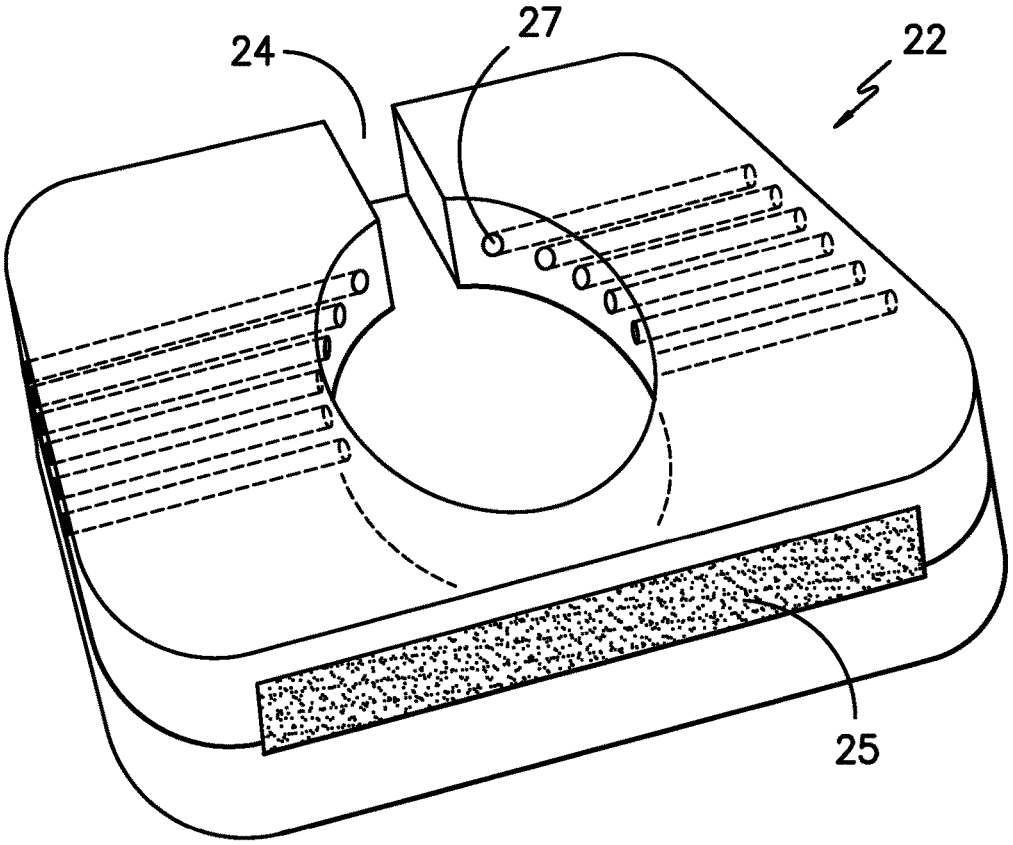
FIG. 5 illustrates a perspective view of a preferred embodiment of the horseshoe pillow with oval-shaped face hole and a gap in the upper edge for adjustment and ventilation, further showing an optional strip of hook and loop fasteners.

When the contour 21 and horseshoe pillows 22 are used together in the face down, prone, configuration, it is contemplated that the lower horseshoe pillow 22 may preferably include an oval shaped opening incorporating a gap 24, or separation, at the top of the oval (as shown in FIG. 5); and surface side "B" of the wedged contour pillow 21 may preferably incorporate a contoured wedge design with cervical/lumbar roll 23. The horseshoe pillow 22 with face opening may provide proper support and cushioning for the forehead, cheeks, and chin for prone use. The thickness of the horseshoe pillow 22 is preferably sufficient such that when the user places his or her face in the opening of the pillow, the user's face and nose remain suspended and preferably do not touch the supporting surface on which the pillow rests. Preferably, dual density foams or other suitable cushion material may be used to provide softer foam for comfort in the pillow areas contacting the user's body. Depending on the density of the material selected, it is contemplated that the thickness will preferably be approximately 3 inches. It is contemplated that the horseshoe pillow 22 may be used in the prone position with the gap 24 of the horseshoe oriented either at the user's chin, or alternatively oriented at the user's forehead.

Figure 7:
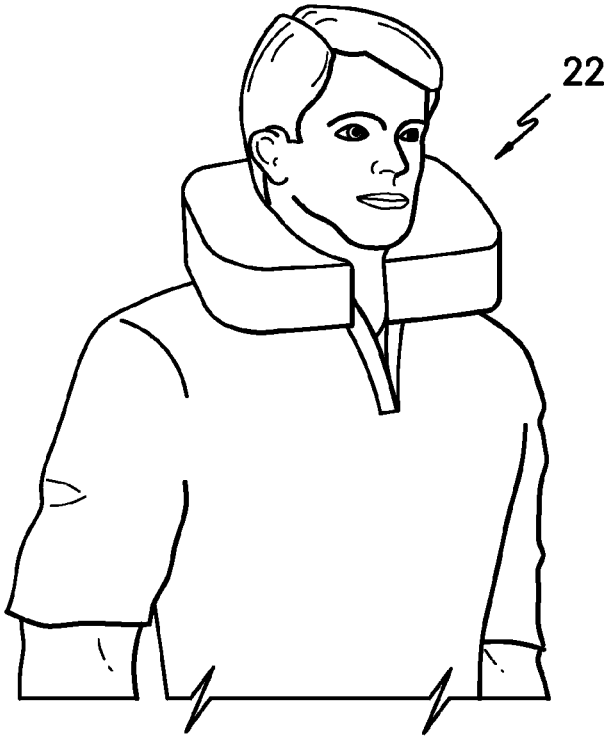
FIG. 7 illustrates an in-use view of a preferred embodiment of the cervical horseshoe pillow as a stand-alone cervical neck pillow.
Figure 9:
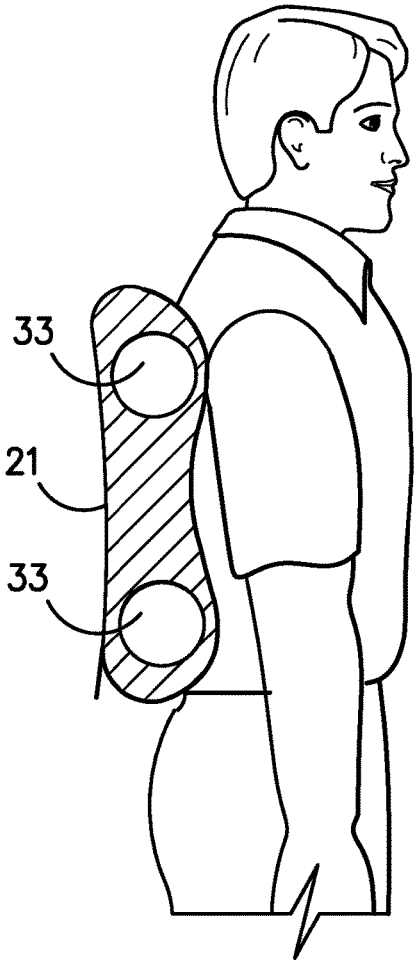
FIG. 9 illustrates an in-use view of a preferred embodiment of the contour wedged pillow as a stand-alone lumbar support pillow with surface "B" facing the lumbar back region and surface "A" against the supporting surface.
Figure 10:
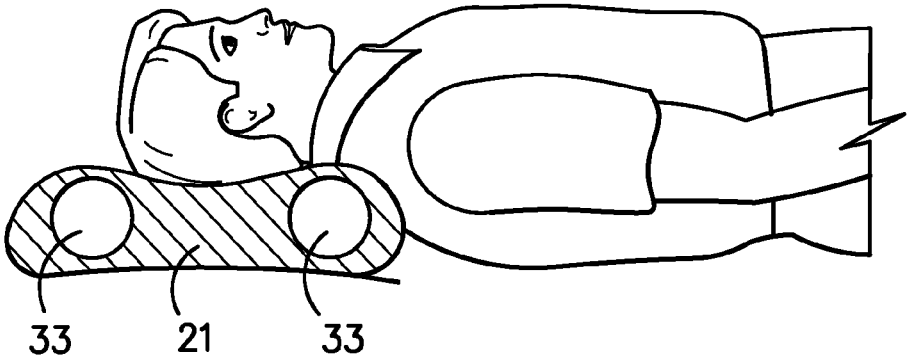
FIG. 10 illustrates an in-use view of a preferred embodiment of the contour wedged pillow as a stand-alone cervical support pillow with surface "B" facing the cervical neck region and surface "A" against the supporting surface.

In addition to using both the wedged contour pillow 21 and the horseshoe pillow 22 together in combination configurations as described, the wedged contour pillow 21 and the horseshoe pillow 22 may also be separated and used independently. When separated, the contoured transitional pillow 21 may be used separately as a lumbar support pillow and cervical support pillow as shown in FIGS. 9 and 10, respectively. The cervical horseshoe pillow 22 may be used as a standalone neck support/travel (horseshoe) pillow as shown in FIG. 7.

Figure 3:
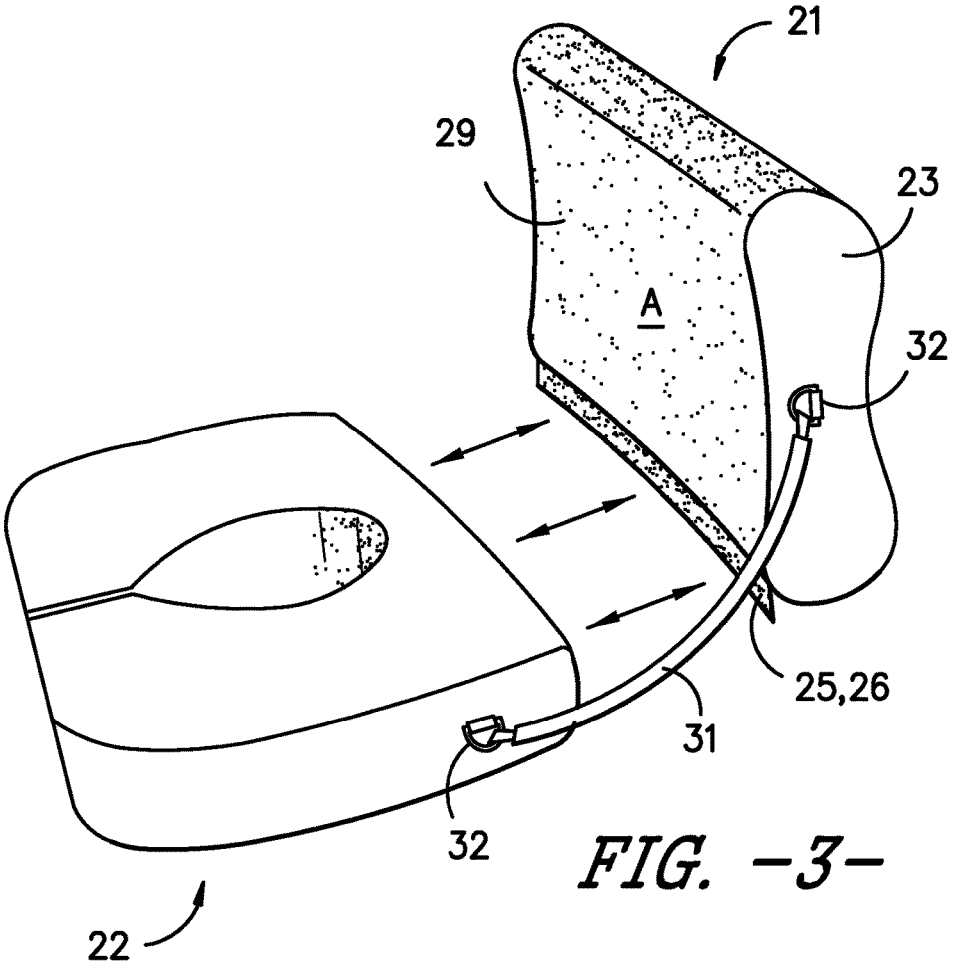
FIG. 3 illustrates an exploded view of a preferred embodiment of the two pillow configuration for use as a combined cervical horseshoe pillow and head cushion with optional hinge means for removable attachment of the two pillows.
Figure 4:
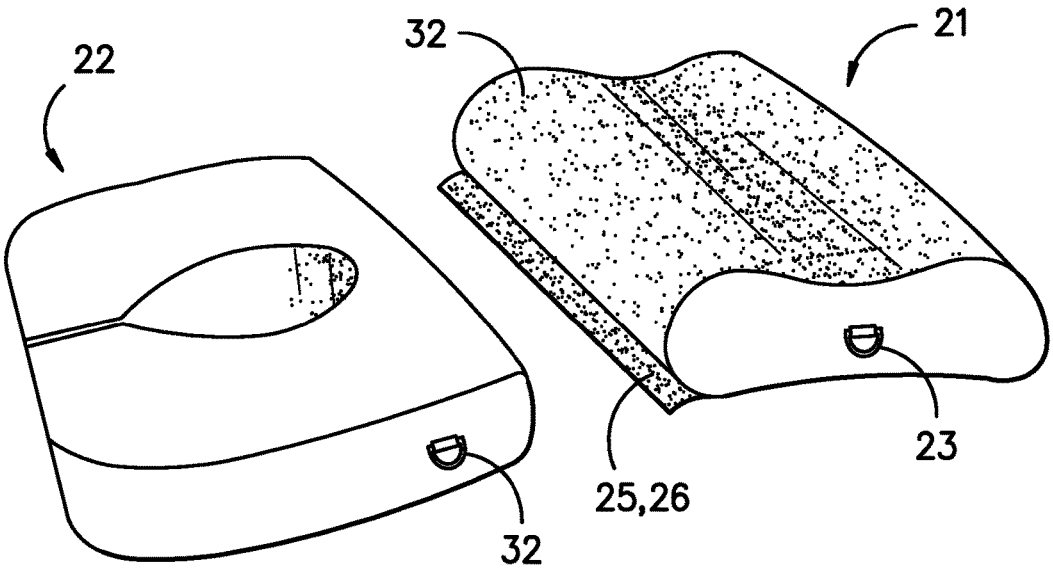
FIG. 4 illustrates a perspective view of a preferred embodiment of a separated configuration of the contour wedged pillow and horseshoe pillow.
Figure 12:
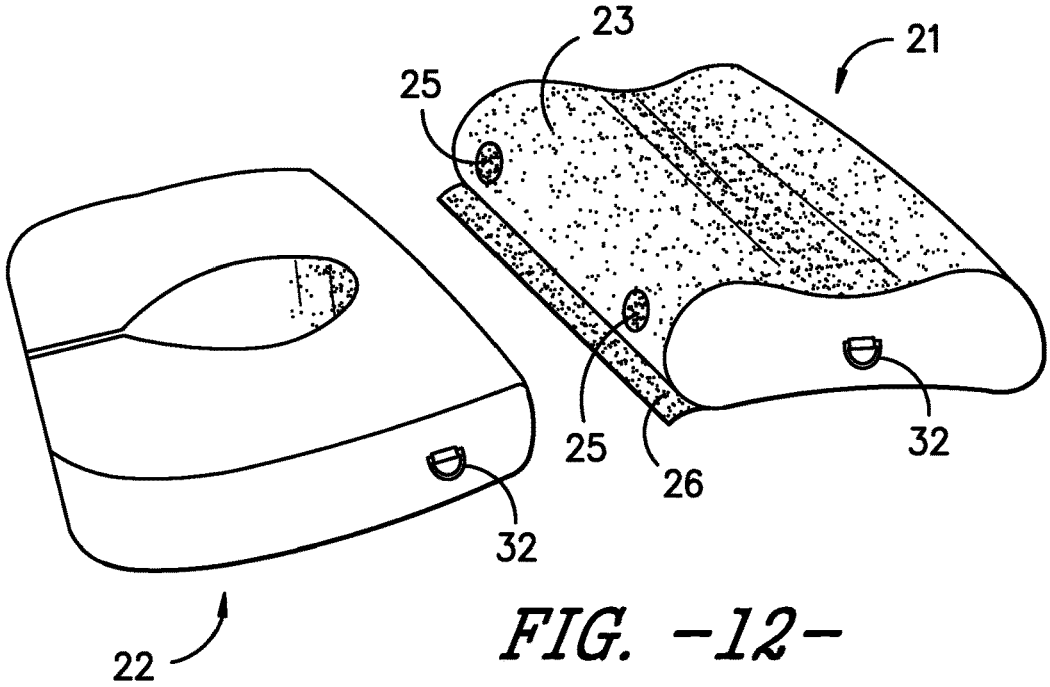
FIG. 12 illustrates a perspective view of a preferred embodiment of a separated configuration of the contour wedged pillow and horseshoe pillow, with the contour pillow including optional means of removable attachment.
Figure 13:
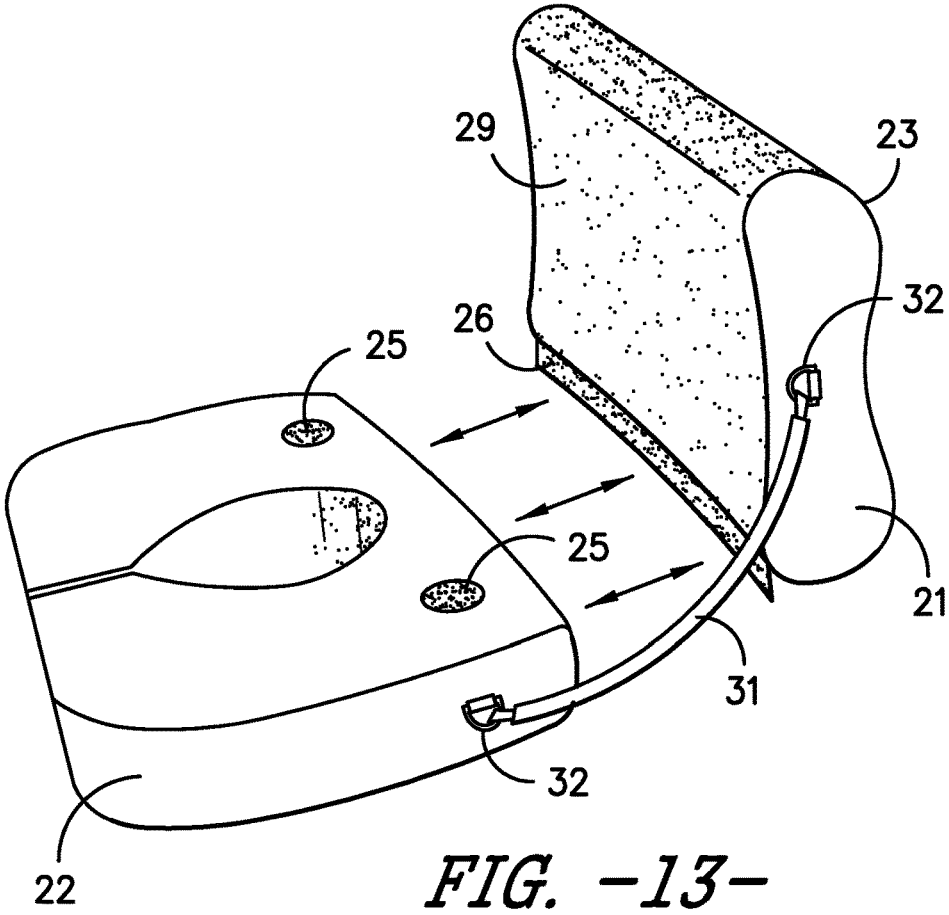
FIG. 13 illustrates an exploded view of a preferred embodiment of the two pillow configuration for use as a combined cervical horseshoe pillow and head cushion, with the horseshoe pillow and contour pillow including optional means of removable attachment.

The present invention may incorporate an optional removable attachment means 25 allowing for the attachment, separation and re-attachment of the contour 21 and horseshoe pillows 22, allowing each pillow to be used separately or together, as desired. These removable attachment means 25 may be present along any edge, surface, or in any other suitable location as desired. Such means 25 may include hook and loop fasteners, zippers, snaps, buttons, or any other appropriate means of attachment and detachment. Preferably, the lateral edge of the wedged contour pillow 21 may be removably attached to the lateral edge of the horseshoe pillow 22, opposite the opening of the horseshoe, through a strip of corresponding hook and loop fasteners, as shown in FIGS. 3-5. The upper and lower pillows may be covered in fabric, or any other suitable material. In one embodiment, a flap of fabric 26 including a means for removable attachment 25, may be positioned on the lateral edge of surface side "A" of the wedged contour pillow 21. This flap 26 may act as a hinge to allow for surface side "A" of the contour pillow 21 to fold or flip on top of the horseshoe pillow 22, as show in FIGS. 3 and 4. Preferably, a corresponding means of removable attachment 25 may be positioned on the horseshoe pillow 22 (as shown in FIG. 5) on an edge opposite the opening of the horseshoe, and corresponding to the attachment means of the contour pillow 21. A similar flap of fabric 26 may also be utilized on the bottom edge of the horseshoe pillow 22, if so desired. FIGS. 12 and 13 illustrate an embodiment whereby a means of attachment 25 may be included in a location optimal for securing an edge of the contour pillow 21 to a corresponding edge of the horseshoe pillow 22 when using both pillows in the combination configuration shown in FIGS. 2 and 8. Similarly, FIG. 13 illustrates an embodiment whereby the horseshoe pillow 22 includes removable attachment means 25 in a location optimal for securing surface side "A" of the contour pillow 21 on top of the upper surface of the horseshoe pillow 22, ideally when used for the combination configuration shown in FIG. 1. Including optional attachment means 25 in the aforementioned locations allow for the contour pillow 21 to remain stationary for the intended use.

In a preferred embodiment, the dimensions of the upper and lower pillows individually may be approximately 12 inches wide, 9 inches long and 3 inches thick. Preferably, the lower wedged contour pillow 21 (surface "B") may be approximately 3 inches thick at the thickest portion, comprising the cervical/lumbar roll 23, and may gradually slope down in height preferably to approximately 1 to 2 inches at the thinnest portion. Said dimensions are approximate and may be increased, decreased, or adjusted while still achieving the desired function.

The pillows may be constructed from fabric or any other suitable material, and the cushioned fill material may be preferably foam rubber, although granular fill, buckwheat or the like may also be utilized. In one embodiment, the unfolded outer dimensions of the two pillow design (when utilized for prone use) are preferably 12 inches wide, 18 inches long and 3 inches deep at the thickest points. Said dimensions may be increased, decreased, or changed as necessary. The aforementioned flap 26 configuration with means of removable attachment 25 allows the upper contour pillow 21 and lower horseshoe pillow 22 to fold on top of one another, as depicted in FIG. 1. When folded together, the flat planar surface (side "A") of the lower contour pillow 21 may rest on top of the upper horseshoe pillow 22, as depicted in FIG. 1.

Optionally, a means of ventilation 27 may also be included in the design of the pillows. Preferably, the means of ventilation and adjustment during prone use may be accomplished by incorporating a gap 24 at the top center portion of the face hole (oval), as shown in FIG. 5. Unlike a typical horseshoe pillow 22, which does not provide any cushioning projecting inward at the top of the "U", the horseshoe pillow 22 of the present invention may utilize an oval opening with a gap 24 at the top of the oval, as shown in FIGS. 2-5. Additionally, the design of the horseshoe pillow 22 may preferably incorporate additional circular cushioning around the circumference of the oval, on the upper surface of the pillow, thereby providing a contoured surface around the top of the head area to further support the forehead.

As illustrated in FIG. 5, the width of the gap 24 at the top of the face hole (oval) may be adjusted wider or narrower for a larger or smaller head size, respectively. Widening or narrowing the gap 24 provides for adjustment and customized fit depending on the head size of the user. The preferable adjustment, as shown in FIG. 5, may be possible due to the flexibility of the foam cushioning and the approximate dimensions of the face hole; for example, in one embodiment there may be a relatively narrow (approximately 1-2 inches) section of foam on the horseshoe pillow 22, opposite the face hole gap 24 and closest to where it may attach to the contour pillow 21. The desired adjustment size of the face hole may be maintained by the weight of the head resting upon the pillow surface. In one embodiment, a wire of sufficient length and gauge and capable of holding its form, such as steel, aluminum, copper or the like, may be inserted into the foam at the bottom opening of the oval to provide a means to hold the adjustable opening in place. The chin area or any other area of the face opening may also include ventilation means 27 such as extended channel-type openings, running laterally from the inner edges of the face hole to the outer edges of the pillow 22, to allow for ventilation and easier breathing while lying in a prone position. For example, sections of tubing or the like, in an appropriate diameter and length, may be inserted into the foam extending from the inner surface edge of the face hole outwardly to the outer edges of the foam cushion to further provide for additional ventilation while the pillow is being used in the prone position. Elevated supports or cushions may be utilized around the face opening at the areas where the forehead, cheeks and chin rest. Said elevated supports or cushions may provide for additional comfort and ventilation.

Figure 11:
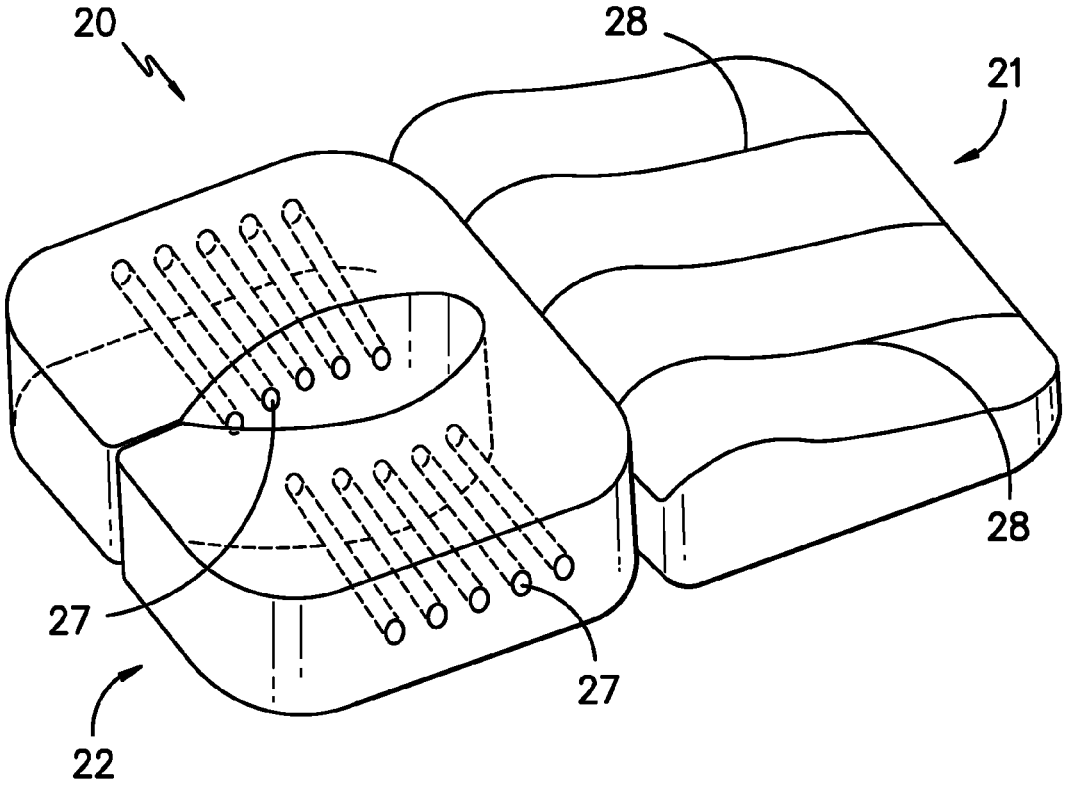
FIG. 11 illustrates a perspective view of a preferred embodiment of the combined two pillow configuration whereby surface side "B" of the contour pillow includes a plurality of optional slits to allow for an expansion in pillow surface area.
Figure 15:
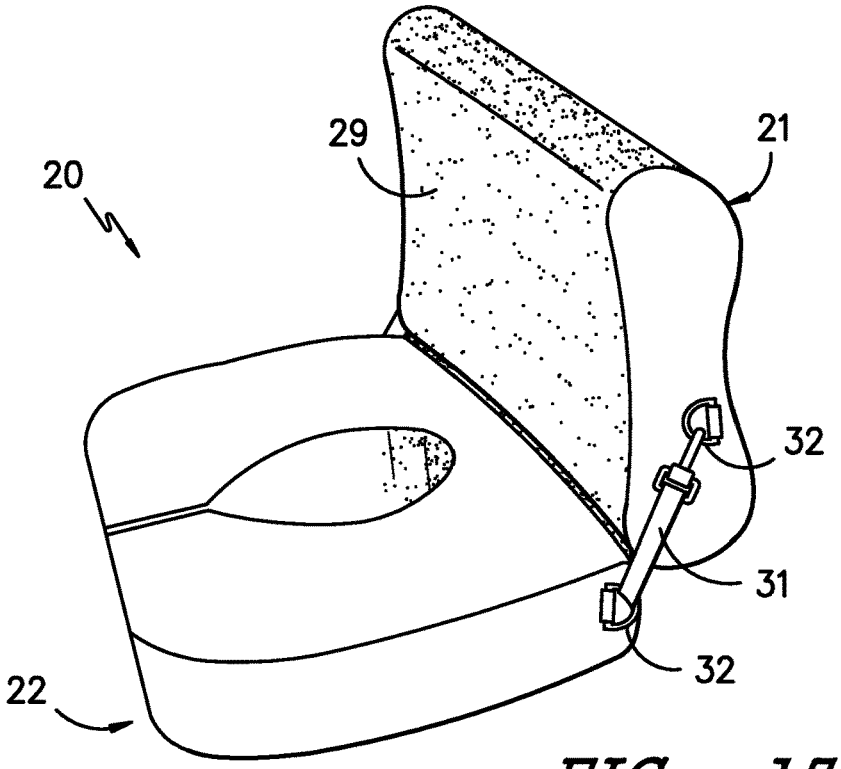
FIG. 15 illustrates a perspective view of one embodiment of a two pillow configuration whereby a strap is configured to hold the back head cushion/lateral support pillow at an upward angle in combination with the cervical horseshoe pillow.
Figure 16:
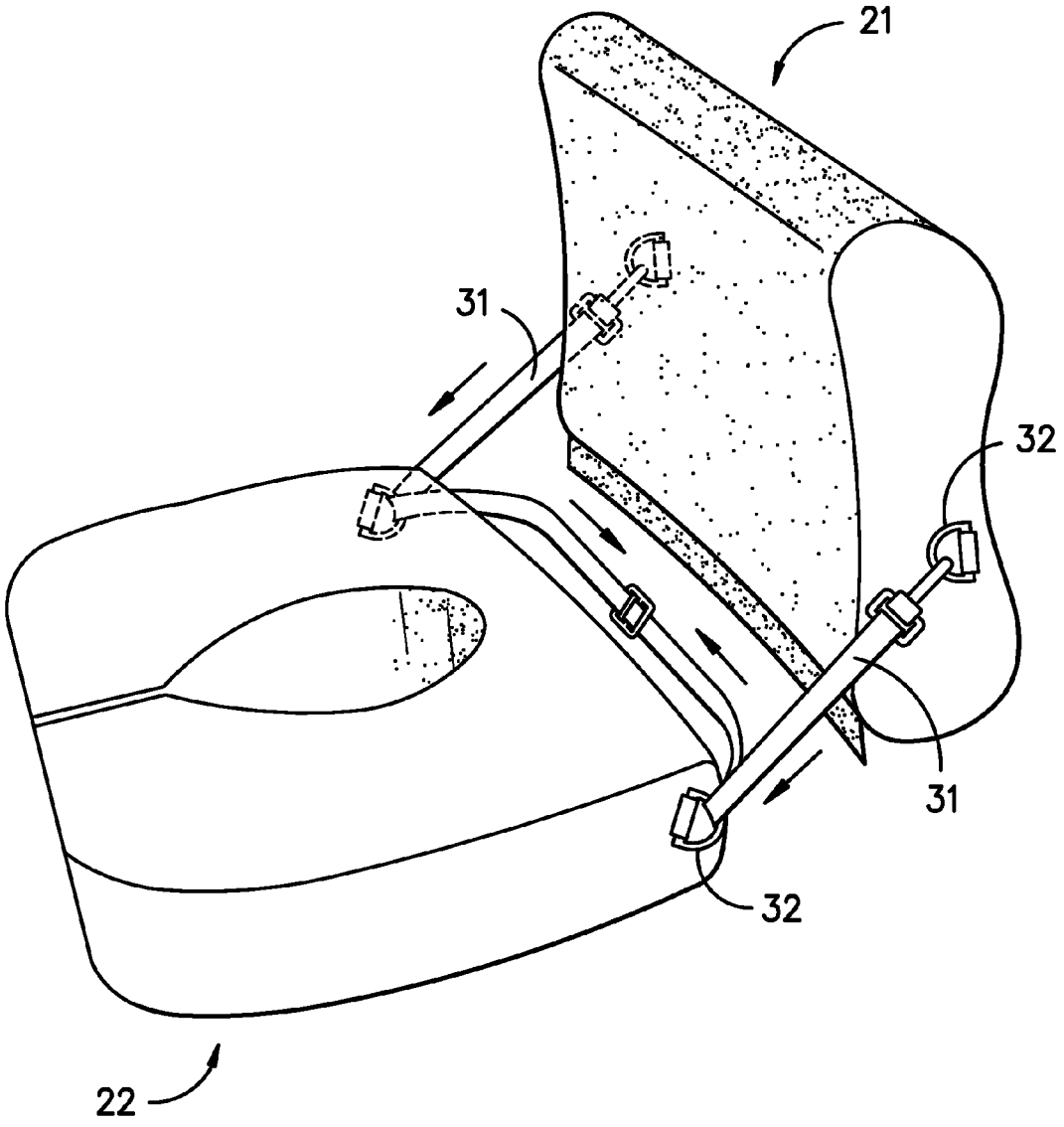
FIG. 16 illustrates an exploded view of one embodiment of a two pillow configuration showing how a strap is configured to hold the back head cushion/lateral support pillow at an upward angle in combination with the cervical horseshoe pillow.

FIGS. 2 and 15 illustrate an embodiment of the invention whereby the contour pillow 21 may be attached along a lateral edge to a corresponding lateral edge of the horseshoe pillow 22. The corners of both pillows may be any appropriate shape and angle, such as rounded or squared off; however, it is preferable that the corners of the attaching lateral edge of surface side "A" of the contour pillow 21 may preferably be more angular than the corners of the corresponding lateral edge of the upper surface of the horseshoe pillow 22. These more angular corners may provide additional surface area on the contour pillow 21, such that when the two pillows are attached, the attaching corners of the contour pillow 21 may be pulled around the more rounded corners of the horseshoe pillow 22, thus causing the cushion to bend more easily around the head. Additionally, lengthwise slits 28 may be cut into surface side "B" of the wedged contour pillow 21, as shown in FIG. 11, to facilitate an increase in curvature of the contour pillow 21 around the head. These slits 28 may allow for surface side "B" to expand, while surface side "A" maintains its original dimension, resulting preferably in a curvature to envelope the head and provide lateral support. These slits 28 are optional and may range in size, number, and location. The depth of the cuts should be sufficiently deep to provide the desired function of surface expansion. If included in the pillow design, these slits 28 can allow for outward expansion of surface "B" under the pressure exerted by pulling and attaching the flap of material around the less angular corners of the lower pillow. In a preferred embodiment illustrated by FIG. 3, when the corresponding corners of the flap on the upper contour pillow are attached to the corresponding corners of the lower horseshoe pillow, a desirable curvature may be accomplished and maintained. In addition to slits 28, angular corners, and other means previously described to accomplish a curvature for lateral head support, a desired curvature may also be fabricated into surface side "A" of the upper contour pillow 21; said curvature being of sufficient arc to accomplish the desired function of enveloping a user's head. Formable wire or mesh may be inserted within the upper contour pillow 21 to further allow for a curvature to provide lateral support for the head. Additionally, when using the pillows in the combination configuration depicted in FIG. 6, a means of fastening 25 may be affixed to surface side "B" of the contour pillow 21, as shown in FIG. 12, and to the corresponding upper surface of the horseshoe pillow 22, as shown in FIG. 13, thus providing for increased curvature when both pillows are attached in the manner described.

The two pillow configuration may further be used in conjunction as a folded cervical support pillow 21 as shown in FIG. 1. This configuration may be utilized as a traditional bed pillow with the elevated cervical roll 23 of surface "B" of the upper contour wedged pillow 21 preferably situated under the neck with the tapered, lower portion of surface "B" projecting upward toward the top of the head as depicted in FIG. 10.

When the upper and lower pillows are separated, each may be used individually. The lower horseshoe pillow 22 may be used as a stand-alone cervical horseshoe pillow while the contour pillow 21 may be used as a stand-alone cervical or lumbar contour pillow. FIG. 7 depicts the lower pillow utilized as a stand-alone cervical horseshoe pillow 22. FIGS. 9 and 10 depict the upper contour pillow 22 as both a stand-alone lumbar (FIG. 9) and cervical (FIG. 10) pillow. When separated as stated herein, it is contemplated that the upper and lower pillows may be used in conjunction at the same time as both a cervical horseshoe pillow 22 and a lumbar support pillow 21.

Preferably, the wedged contour pillow 21 may function as both a cervical support pillow and a lumbar support pillow. To accomplish this dual use, surface side "B" of the upper pillow may incorporate a roll 23, or curvature, of sufficient width and height so as to accomplish the desired function. A frictional means 29 may be attached to the surface side "A" of the upper contour pillow so as to prevent slippage or sliding when used on an angled surface such as a lounge chair or weight bench. Such frictional means 29 may include coarse or textured fabric, topically applied spray, or any other material possessing the necessary properties to create a frictional effect. The lower cervical horseshoe pillow 22 may further be used individually as a face down, or prone, pillow. This use would be beneficial when there is insufficient space for it to be used in combination with the upper wedged contour pillow 21. It is contemplated that the lower cervical horseshoe pillow 22 may be used in this fashion on a tray table when seated on an airplane or on a desk when seated.

Figure 14:
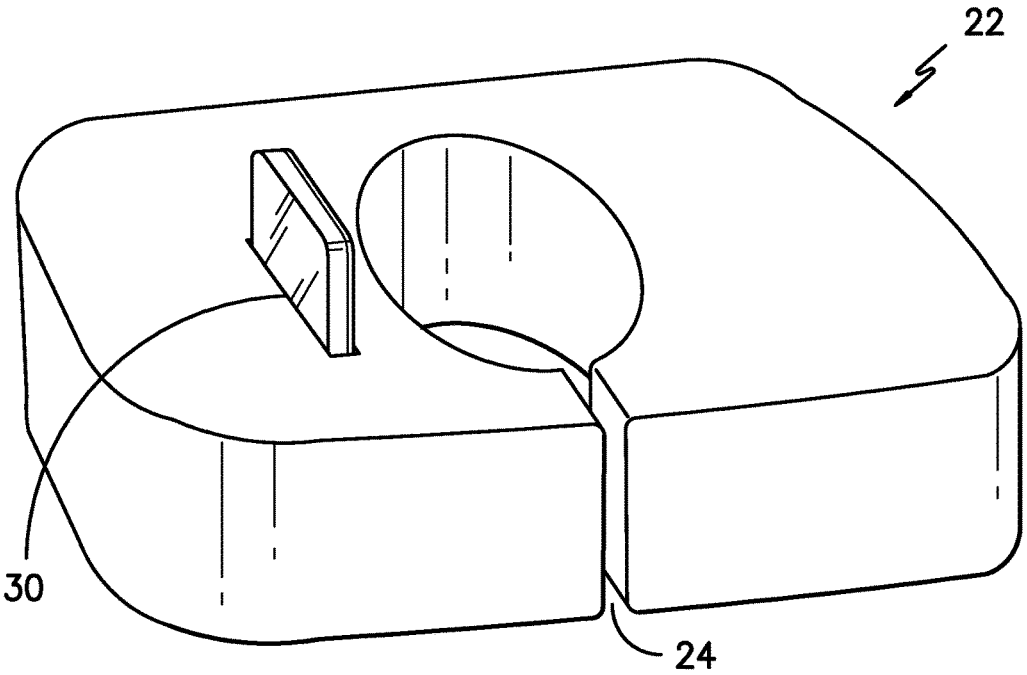
FIG. 14 illustrates a perspective view of one embodiment of the horseshoe pillow with an optional slot for a cell phone or portable audio player.

Different features may be added to the present invention, as desired. For example, FIG. 14 illustrates a slot 30 that may be included in the horseshoe pillow 22, preferably at a location near the ear, for inserting a cell phone or portable audio device. This optional feature may provide the user a hands-free way to talk on the phone, listen to music, listen to a sound machine while resting, or perform other hands-free listening activities.

Another feature that may be added is a means to adjust the firmness 33 of the pillow which may be included in one or both of the pillows. Preferably, this feature may be added to the contour pillow 21 in the form of one or more lumbar support mechanisms 33, as shown in FIGS. 9 and 10. This adjustment may be accomplished through an inflatable bladder or the like that can be inserted or included inside the pillow at a strategic location suitable to provide the desired support. For example, FIG. 9 shows two such adjustable support mechanisms 33—one in the lower portion of the pillow to support the lumbar region of the user, and one in the upper portion of the pillow to support the thoracic or cervical region of the user. It is contemplated that the bladder may be inflated as needed to increase the firmness of that section of the pillow, or deflated as needed to decrease the firmness of that section of the pillow. In place of an inflatable bladder, an actuator may be used to increase and decrease firmness as desired. This actuator may include a knob that can be turned to adjust firmness, similar to the lumbar support mechanisms that can be found in car seats or office chairs.

It is also contemplated that an embodiment of the present invention may be fashioned for use on weight-lifting benches or the like to provide support to the cervical and lumbar spine during supine use. The preferred embodiment of such version may be fashioned from a molded foam or the like comprised of two separate cushions, one for cervical support and the other form lumbar support. Each separate cushion incorporates curves or arches in the appropriate dimensions to respectively support the cervical and lumbar spine and to fit onto a typical weight bench, seat or the like. Said separate support cushions being fashioned into appropriate dimensions so that such cushions have minimal thickness in all areas other than at the elevated curved or arched support areas. The two separate cushion design allows for each to be moved independently so that they may be adjusted for different sized users.

Construction of the invention may be accomplished in a multitude of materials and construction techniques. These materials include a sewn fabric cover filled with granular fill particles, foam rubber, foam beads, memory foam, silicone, buckwheat or the like. A moisture and water-resistant outer cover may also be provided. For example, foam rubber or the like may be cut to the desired shape and dipped into vinyl, plastic or the like to provide a moisture resistant outer foam cover. In a preferred embodiment, a separate removable, washable cover may be fashioned for hygiene, to absorb perspiration, and to prevent absorption into the inner cushioning. This separate, removable fabric cover may be provided for both the lower horseshoe pillow and upper wedged contour pillow. Said cover may be a one or two piece design slipped over the pillows and removed for washing. The removable cover may be cut to the proper shape to cover the facial surface of the lower horseshoe pillow and to cover both surfaces of the upper wedged contour pillow. This removable cover may be made from terry cloth, cotton or any other appropriate material with preferably elastic or the like sewn around the edges. To provide a pleasant aroma, the cushioned material may optionally be infused with a variety of aromatic fragrances such as potpourri, essential oils, and the like.

Additionally, the present invention may be constructed from inflatable materials to provide a very portable, inflatable version of the two section pillows. The pillows may be comprised of inflatable plastic bladders or shells so that they may be inflated with air and subsequently deflated as would an inflatable beach ball. This inflatable version may also include a removable slip cover of fabric or the like to provide more comfort during use.

In a preferred embodiment, the present invention may include an adjustable strap 31. The strap 31 may be removably attached through D-rings, mating snap hooks, or the like; and the strap 31 may have an adjustable length for loosening or tightening. FIGS. 1, 3, 13, 15, and 16 illustrate the pillow including a strap 31 attached through the use of D-rings 32. The strap 31 may be attached and positioned anywhere as desired; however, it is preferred to have at least one D-ring 32 generally centered on each side of the contour pillow 21, and at least one D-ring 32 on each side of the horseshoe pillow 22 positioned generally near the closed end of the horseshoe shape. The strap 31 may be used to carry the pillow, and it may be used to hold the two pillows together (as shown in FIG. 1). It is contemplated that when traveling, a blanket, book, stuffed animal, or any other item could be slipped under the strap 31, between the strap and the pillow, to secure the item together with the pillow for easy travel.

The strap 31 may also be used in different configurations to assist in the use of the pillow. For example, the strap 31 may be attached to one side of the contour pillow 21, wrapped around a user's waist, and then attached on the other side of the contour pillow 21 to help secure the pillow to the lumbar region of the user's body. In yet another configuration shown in FIGS. 15 and 16, the strap 31 may be configured to hold the contour pillow 21 and horseshoe pillow 22 at a generally 90 degree angle from one another. This strap configuration can assist a user when utilizing the functional pillow arrangement illustrated in FIG. 6. As shown in the exploded view of FIG. 16, to perform this 90 degree strap configuration, the strap 31 may be attached to a D-ring 32 located on the contour pillow 21, then slipped through a D-ring 32 located on the corresponding side of the horseshoe pillow 22, pulled across the back of the horseshoe pillow 22 and slipped though the adjacent D-ring 32 on the horseshoe pillow 22, then finally attached to a D-ring 32 located on the adjacent side of the contour pillow 21. When the strap 31 is pulled to sufficient tightness, the pillows will remain at a generally 90 degree from one another without the assistance of the user.

While the spirit of the invention has been described in detail with reference to particular embodiments, the embodiments are for illustrative purposes only and do not limit the invention. It is to be appreciated that those skilled in the art can change or modify the embodiments without departing from the scope and spirit of the invention. It is to be understood that the inventive concept is not to be considered limited to the constructions disclosed herein, but instead by the scope of the claims to be submitted in an application that claims the benefit of priority from this provisional application.

The terms used in the present application are merely used to describe particular embodiments, and are not intended to limit the present invention. An expression used in the singular encompasses the expression of the plural, unless it has a clearly different meaning in the context. In the present application, it is to be understood that the terms such as "including" or "having," etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

What is claimed:

1. A multi-functional pillow comprising:

a wedge shaped first pillow having a first and a second side, the first side having a generally flat surface and the second side having a contoured surface comprising at least one lobe and depression;

a second pillow being generally horseshoe shaped and said second pillow is of generally uniform thickness;

whereby said first pillow includes a means for attachment along an edge thereof and said second pillow includes a corresponding means for attachment along an edge thereof, such that said first and second pillow may be removably attached to one another; and whereby said means for attachment may be used to fold the first pillow atop the second pillow such that the first side of the first pillow rests on a surface of the second pillow.

2. The pillow according to claim 1, whereby said means for attachment is selected from a group consisting of hook and loop strips, snap fasteners, zippers, and buttons.

3. The pillow according to claim 1, whereby said second side said first pillow includes at least one curved contour roll.

4. The pillow according to claim 1, whereby a means for frictional engagement is included on at least one surface thereof.

5. The pillow according to claim 1, further including an adjustable strap removably attached thereto.

6. The pillow according to claim 5, further including at least a first D-ring and a second D-ring affixed to opposing sides of the first pillow, and a third D-ring and a fourth D-ring affixed to opposing sides of the second pillow.

7. The pillow according to claim 5, further including a strap configuration whereby the first pillow is held in a generally fixed position with relation to the second pillow when said second pillow is disposed around a user's neck.

8. The pillow according to claim 7 whereby said generally fixed position is a relatively 90 degree angle.

9. The pillow according to claim 1, whereby the second side of the first pillow includes a multitude of lengthwise slits for providing surface area expansion and inward curvature of said second side when pressure is applied thereto.

10. The pillow according to claim 1, whereby said first and second pillow both further include a removable, washable slip cover that may he slipped over each pillow for use.

11. The pillow according to claim 1, whereby said first and second pillows are constructed from a fabric cover filled with filling selected from a group consisting of polyester beads, microbeads, polystyrene beads, buckwheat, flaxseed, feathers, and fiber batting.

12. The pillow according to claim 1, whereby said first and second pillows are constructed from a material selected front a group consisting of memory foam, gel foam, rubber foam, and dual density foam.

13. The pillow according to claim 1, whereby said first and second pillows are inflatable.

14. The pillow according to claim 1, whereby the width of the U-shaped portion of said second pillow is in the range of 1-3 inches, allowing a user's head to tilt backward when resting on said second pillow.

15. The pillow according to claim 1, further including a slot located on the upper surface of the horseshoe pillow for partial insertion of a mobile listening device, said slot positioned such that said device may be held in a upward position near a user's ear.

16. The pillow according to claim 1, whereby said second pillow further including a means for ventilation running laterally from the inner edge of said second pillow to the outer edge of said second pillow.

17. The pillow according to claim 1, further including a means for adjustable support included in the interior of at least the first pillow such that the firmness of the pillow may be increased or decreased as needed.

18. The pillow according to claim 17, whereby said means for adjustable support is an inflatable bladder.

19. A multi-functional pillow comprising:

a wedge shaped first pillow having a first side, and a second side;

a second pillow being generally horseshoe shaped having two parallel sides and perimeter face there-between so said second pillow is of generally uniform thickness;

whereby said first pillow includes a means for attachment along an edge thereof and said second pillow includes a corresponding means for attachment upon said perimeter face thereof, such that said first and second pillow may be removably attached to one another; and whereby said means for attachment may be used to fold said first pillow atop said second pillow such that the first side of said first pillow rests on one of said sides of said second pillow.

* * * * *